US006877569B2

(12) United States Patent
Koskimäki

(10) Patent No.: US 6,877,569 B2
(45) Date of Patent: Apr. 12, 2005

(54) METHOD FOR CONTROLLING OPERATING CYCLE OF IMPACT DEVICE, AND IMPACT DEVICE

(75) Inventor: Antti Koskimäki, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/702,732

(22) Filed: Nov. 7, 2003

(65) Prior Publication Data

US 2004/0144551 A1 Jul. 29, 2004

Related U.S. Application Data

(63) Continuation of application No. PCT/FI02/00386, filed on May 7, 2002.

(30) Foreign Application Priority Data

May 9, 2001 (FI) ..... 20010976

(51) Int. Cl.[7] ..... B25D 9/26; E21B 44/00

(52) U.S. Cl. ..... 173/1; 173/2; 173/135; 173/206

(58) Field of Search ..... 173/1, 2, 91, 135, 173/137, 206, 207, 208, 132; 175/196; 91/39, 40

(56) References Cited

U.S. PATENT DOCUMENTS

| | | | | |
|---|---|---|---|---|
| 3,805,896 A | | 4/1974 | Bauer | |
| 4,308,924 A | * | 1/1982 | Boguth | 173/135 |
| 4,349,075 A | * | 9/1982 | Henriksson | 173/208 |
| 4,505,340 A | * | 3/1985 | Yantsen et al. | 173/208 |
| 4,582,145 A | * | 4/1986 | Salmi et al. | 173/64 |
| 4,699,223 A | | 10/1987 | Noren | |
| 4,993,504 A | * | 2/1991 | Rodert et al. | 175/135 |
| 5,408,768 A | * | 4/1995 | Karani | 37/466 |
| 5,479,996 A | * | 1/1996 | Jonsson et al. | 175/135 |
| 5,520,254 A | * | 5/1996 | Weber | 173/128 |
| 6,273,199 B1 | * | 8/2001 | Kiikka et al. | 173/1 |
| 6,371,222 B1 | * | 4/2002 | Andersson et al. | 175/135 |

FOREIGN PATENT DOCUMENTS

| | | |
|---|---|---|
| EP | 0112810 A2 | 7/1984 |
| EP | 0 426 928 A1 | 5/1991 |
| FR | 2 601 764 | 1/1988 |
| GB | 2062124 A | 5/1981 |
| WO | 99/54094 | 10/1999 |

* cited by examiner

*Primary Examiner*—Scott A. Smith
(74) *Attorney, Agent, or Firm*—Burns, Doane, Swecker & Mathis, L.L.P.

(57) ABSTRACT

A method for controlling the operating cycle of an impact device, and an impact device. Percussion piston position is measured using a sensor (11) from which the measurement data is transmitted to a control unit (12) of the impact device, which in turn controls an electrically driven control valve (10).

10 Claims, 6 Drawing Sheets

METHOD FOR CONTROLLING OPERATING CYCLE OF IMPACT DEVICE, AND IMPACT DEVICE

This application is a continuation of international PCT application Serial No. PCT/FI02/00386, filed May 7, 2002, which was published in English as WO 02/090057 A1 on Nov. 14, 2002, and which is incorporated by reference.

FIELD OF THE INVENTION

The invention relates to a method for controlling the operating cycle of an impact device, the impact device comprising a frame, a percussion piston, working pressure surfaces formed on the percussion piston and acting both in the impact direction and in the return direction, working pressure ducts and discharge ducts for guiding pressure medium to act on the working pressure surfaces, and at least one control valve, the method comprising varying the pressure medium flows acting on the working pressure surfaces of the percussion piston, by means of the control valve, so as to produce a reciprocating impact and return motion according to the operating cycle of the percussion piston, and for delivering impacts on a tool arranged in the impact direction of the percussion piston.

The invention further relates to an impact device comprising a frame, a percussion piston, working pressure surfaces formed on the percussion piston and acting in the impact direction and in the return direction, working pressure ducts and discharge ducts for guiding pressure medium, and at least one control valve for guiding pressure medium from the working pressure duct to act on the working pressure surfaces of the percussion piston, and away from them to the discharge ducts so as to reciprocate the percussion piston in relation to the frame and to deliver blows on a tool arranged in the impact direction of the percussion piston.

BACKGROUND OF THE INVENTION

Hydraulically operated impact devices are used for example in drilling machines designed for rock drilling and in different impact hammers designed for breaking rock, concrete and other similar hard materials. Such impact devices are usually arranged to a base machine, such as a movable carrier, and operated by the hydraulics of the base machine.

An impact device comprises a frame and a percussion piston reciprocated in relation to the frame by pressure liquid, compressed air or a similar pressure medium. The percussion piston delivers successive blows via a tool at the object to be handled. The pressure liquid is supplied to and from the percussion piston by means of suitable ducts. The percussion piston comprises working pressure surfaces and by varying the hydraulic pressure acting on the surfaces, the percussion piston is engaged in a reciprocating motion required by the operating cycle. Pressure liquid flows to the working surfaces of the percussion piston are typically controlled by means of different control slides. The control slides are moved by guiding a control pressure to act on the working pressure surfaces of the slides. Publication EP 0 426 928, for example, discloses a percussion hammer in which a sleeve-like control valve is arranged around a percussion piston, the control valve being arranged to open and close pressure fluid ducts connected to the working pressure spaces of the percussion piston. Control pressure is supplied from control pressure ducts to shoulders of the sleeve-like control valve to make the sleeve to move in a desired manner and to change the direction of motion of the percussion piston as required by the operating cycle. WO publication 99/54094 describes another solution in which a tube-like control slide is moved in a separate chamber by means of control pressure. The position of the control slide in the chamber defines the pressure fluid flows to the working pressure surfaces of the percussion piston. A common feature of current solutions is that the percussion piston comprises working pressure surfaces, such as shoulders, the motion of the percussion piston causing the surfaces to open and close high-pressure ducts formed in the frame of the impact device, return ducts leading to a tank and the control pressure ducts used for controlling the control slide. The control of the control slide depends on the travel of the percussion piston. The travel direction of the percussion piston can only be changed after the percussion piston has reached a predetermined position where it opens the control pressure conduit of the control slide and changes the position of the control valve. Due to their physical dimensioning, the operating cycles of known impact devices are thus based on fixed timing. Therefore the frequency and velocity of impact can be adjusted during drilling only by changing the impact pressure. A further drawback of known structures is that leakage gaps are fairly wide. Since the frame of the impact device is provided with control pressure ducts connected to the pressure spaces of the percussion piston for controlling the control slides, leakage of pressure medium from the gaps between the shoulders and the pressure spaces into the discharge duct takes placed during an operating cycle. The leakages add to the pressure medium consumption, which must be taken into account when the flow ducts and pumps of the pressure medium are being dimensioned. In addition, leakages naturally degrade the efficiency of the impact device.

BRIEF DESCRIPTION OF THE INVENTION

It is therefore an object of the present invention to provide a new and improved solution for controlling the operation of an impact device.

The method of the invention is characterized in that the method comprises the steps of measuring the position of the percussion piston by means of at least one sensor during an operating cycle and transmitting the measurement data to a control unit of the impact device;

generating an electric control signal in the control unit on the basis of the position of the percussion piston and the control parameters supplied to the control unit for controlling an electrically driven control valve; and guiding the pressure medium, by means of the electrically driven control valve, to act on the working pressure surfaces of the percussion piston, and away from them, for controlling the operating cycle of the impact device.

The impact device of the invention is further characterized in that the impact device comprises at least one sensor for determining the position of the percussion piston in relation to the frame, an electrically driven control valve, and a control unit; that the control unit is arranged to generate a control signal for controlling an electrically driven control valve on the basis of measurement data obtained from the sensor and control parameters supplied to the control unit; and that the electrically driven control valve is arranged to guide pressure medium to act on the working pressure surfaces of the percussion piston, and away from them, for controlling the operating cycle of the impact device.

The invention is based on the idea of measuring the position of the percussion piston during an operating cycle using at least one sensor and transmitting the measurement data to a control unit controlling the percussion function of the impact device. On the basis of the measurement data and the control parameters supplied to the control unit, the control unit generates electric control signals for controlling at least one electrically driven control valve. The electrically driven control valve is configured to guide the pressure medium to act on the working pressure surfaces of the percussion piston so as to move the percussion piston in a desired manner during the operating cycle. An advantage of the invention is that the guiding of the pressure medium to the working pressure spaces of the percussion piston is not dependent on the precise mutual physical position of the percussion piston and the frame of the impact device. The impact device of the invention is thus more freely adjustable than prior art devices. The operation of the impact device can be changed, for different purposes and situations of use, by providing the control unit with new control parameters, without having to re-construct the physical structure of the impact device. For example, the invention allows the impact frequency and the impact speed of the device to be changed during drilling without requiring the impact pressure to be changed. Further, if the impact pressure is also measured, the impact speed can be kept substantially constant by regulating the operating cycle of the impact device. Moreover, the invention may simplify the structure of the impact device, because there are fewer control and pressure fluid ducts to be formed into the frame than before.

An embodiment of the invention is based on the idea of guiding the working pressure flow through the electrically driven control valve to act on the working pressure surfaces of the percussion piston, and away from them. The operating cycle of the percussion piston is thus controlled directly by means of the control valve controlled by the control unit. Since the impact device does not comprise any mechanical control slides or ducts for guiding the control pressure to the slide, the structure of the described impact device is simpler and easier to manufacture than prior art devices.

An embodiment of the invention is based on the idea of using the electrically driven control valve to control the position of a mechanical slide. Depending on its position, the control slide opens and closes pressure fluid ducts, which allow pressure medium to flow into and out of the working pressure spaces of the percussion piston. In this solution the electrically driven control valve is used to provide an indirect control of the movements of the percussion piston because it is used as a pilot control valve to control the actual control element, i.e. the control slide. An advantage of this embodiment over direct control is that there are no great pressure medium flows to be guided through the electrically driven control valve, but only the control pressure flow needed for moving the control slide.

BRIEF DESCRIPTION OF THE DRAWINGS

The invention will be described in greater detail with reference to the following drawings, in which.

For the sake of clarity, the invention is simplified in the drawings. Like elements are referred to using like numerals.

DETAILED DESCRIPTION OF THE INVENTION

Figure 1:
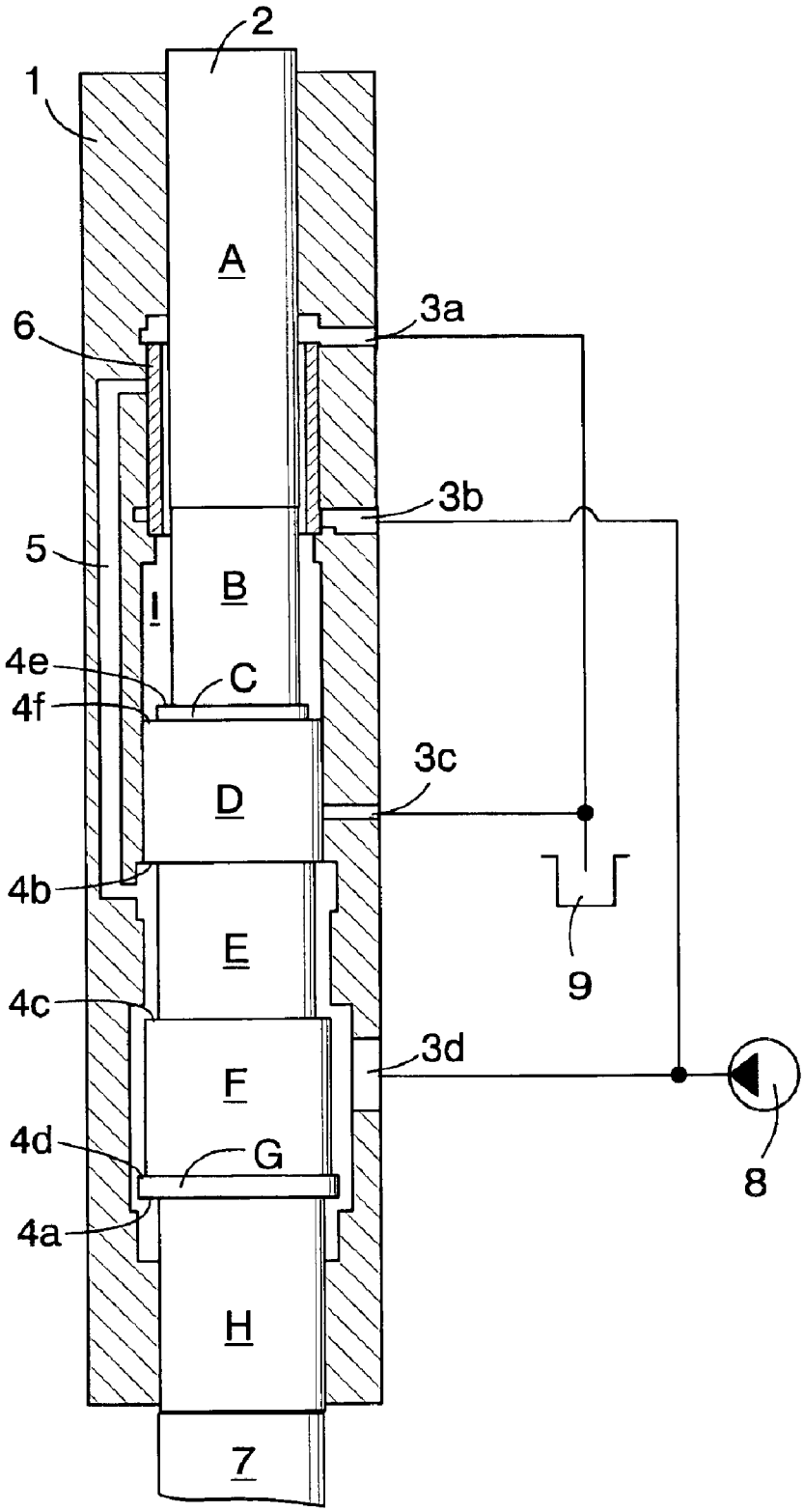
FIG. 1 is a schematic, sectional side view of an impact device controlled by means of a mechanical control slide.

FIG. 1 shows the structure of a conventional impact device. The impact device comprises a frame 1 and a percussion piston 2 arranged to a cylinder space formed in the frame, the piston being moved in a longitudinal direction in relation to the frame 1. At the front end of the percussion piston, aligned with the piston, there is a tool 7. In a rock drilling apparatus, the tool closest to the impact device is the drill shank, which the percussion piston is arranged to strike. The impact force is delivered along drill rods, or similar tools attached to the drill shank, to the furthest element, i.e. the drill bit, which is thus driven into the rock by the impact. When the impact device is arranged to a percussion hammer, the percussion piston delivers blows to a chisel, which delivers the blows further to the object of the operation.

Seen from the rear end of the impact device, the percussion piston 2 comprises portions A—H of different diameters, whereby the percussion piston being thus provided with shoulder-like working pressure surfaces. By changing the pressure of the pressure medium acting on the working pressure surfaces in a suitable manner, the percussion piston is made to move upward in a return direction and, correspondingly, downward, i.e. in the impact direction, as required by the operating cycle of the invention. Pressure medium flows to the working pressure surfaces are controlled by means of a sleeve-like control slide 6 arranged into a space formed around the percussion piston. The control slide around the percussion piston is dimensioned so as to allow the pressure fluid to flow in the annular space between the control slide and the percussion piston. The control slide comprises shoulders to which the control pressure is applied to move the control slide in the direction of motion of the percussion piston in such a way that, depending on its motion position, the control slide either opens or closes pressure fluid ducts connected to the working pressure spaces of the percussion piston. In the following, the operation of the impact device according to FIG. 1 is described in general terms.

Figure 2A:
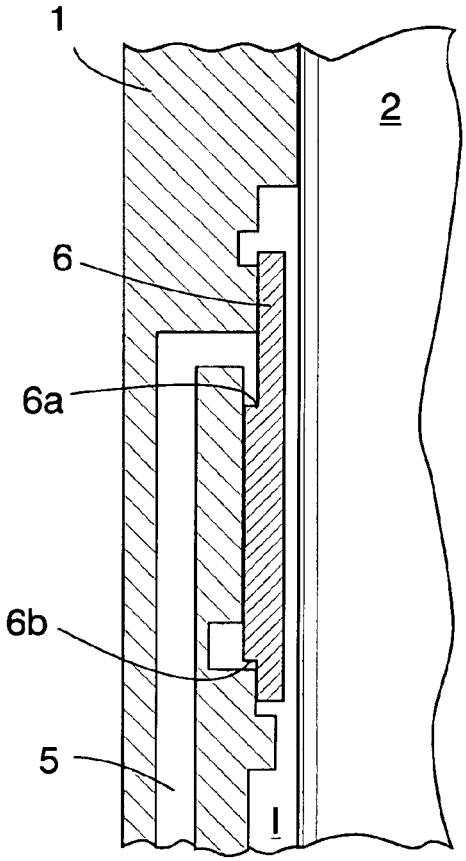
FIGS. 2*a* and 2*b* show details of the schematic, sectional side view of the impact device of FIG. 1.

From the top of the Figure, the impact device comprises a first discharge duct 3*a*, a first working pressure duct 3*b*, a second discharge duct 3*c*, and a second working pressure duct 3*d*. The working pressure ducts 3*b* and 3*d* are subjected to a continuous pressure generated by a pump 8. The discharge ducts 3*a* and 3*c* are in a continuous connection to a tank 9, i.e. they are substantially pressure-free. In the Figure, the control valve 6 is shown in its return position, i.e. it has opened the connection into the first discharge duct 3*a* and, at the same time, closed the connection to the first working pressure duct 3*b*. At the other extreme position of the control valve, i.e. in the impact position, the situation is reversed. A first working pressure surface 4*a* between the percussion piston portions G and H and a second working pressure surface 4*b* between portions D and E are subject to the pressure of the second working pressure duct 3*d*, which tends to lift the percussion piston upward to the impact position. The same pressure also acts on a third working pressure surface 4*c* between portions E and F, and further to a fourth working pressure surface 4*d* between portions F and G, tending to move the percussion piston downward into the impact direction. The working pressure surfaces of the percussion piston are dimensioned so that the total area of the working pressure surfaces 4*a* and 4*b* is greater than that of working pressure surfaces 4*c* and 4*d*, the force lifting the percussion piston upward being thus greater and making the percussion piston move into the impact position. Further, there is an open connection from the second working pressure duct 3*d* along a control pressure duct 5 to a first shoulder 6*a* of the control valve, the control pressure having pushed the control valve into a return position in a manner that is more clearly shown in FIG. 2*a*. In the return position, the pressure space I at the rear end of the percussion piston is connected to the first discharge duct 3*a*, thereby allowing the pressure medium to flow from the space into the tank during the return motion of the percussion piston. In this situation, the space I is substantially pressure-free. When the percussion piston continues its return motion, portion F closes the connection from the second working pressure duct 3*d* to the working pressure surfaces 4*b* and 4*c* and to the control pressure duct 5. Nevertheless, the percussion piston continues its return motion, because the area of the working pressure surface 4*a* is greater than that of the working pressure surface 4*d*. In a situation where percussion piston portion D bypasses the second discharge duct 3*c* and opens a connection to the tank, the control pressure acting on the first shoulder 6*a* of the control slide 6 disappears and, as a result, the control slide pressure from the first working pressure duct 3*b* that acts on the second shoulder 6*b* moves the control slide into the impact position. The first shoulder 6*a* of the control slide is dimensioned to be bigger than the second shoulder 6*b*.

Figure 2B:
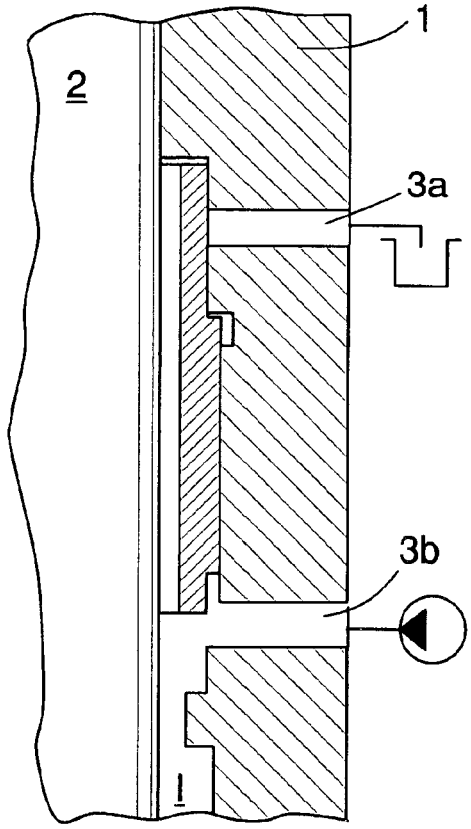

In the impact position shown in FIG. 2*b*, the control slide 6 has closed the connection to the first discharge duct 3*a* and opened the connection to the working pressure duct 3*b*, the pressure of the pressure medium thus acting on the working pressure surfaces 4*e* and 4*f* of the percussion piston. Since the total area of the working pressure surfaces 4*e*, 4*f* and 4*d* is dimensioned to be clearly greater than the area of the working pressure surface 4*a*, the percussion piston starts a rapid impact motion towards the tool. The described self-controlled operating cycle continues as long as pressure medium is supplied to the impact device.

A problem with the above-described impact device is that for example from the gap between portion D of the percussion piston and the frame 1 of the impact device, pressure fluid may leak through the discharge duct 3*c* at portion D into the tank. Such leakages unnecessarily increase pressure medium consumption.

Figure 3A:
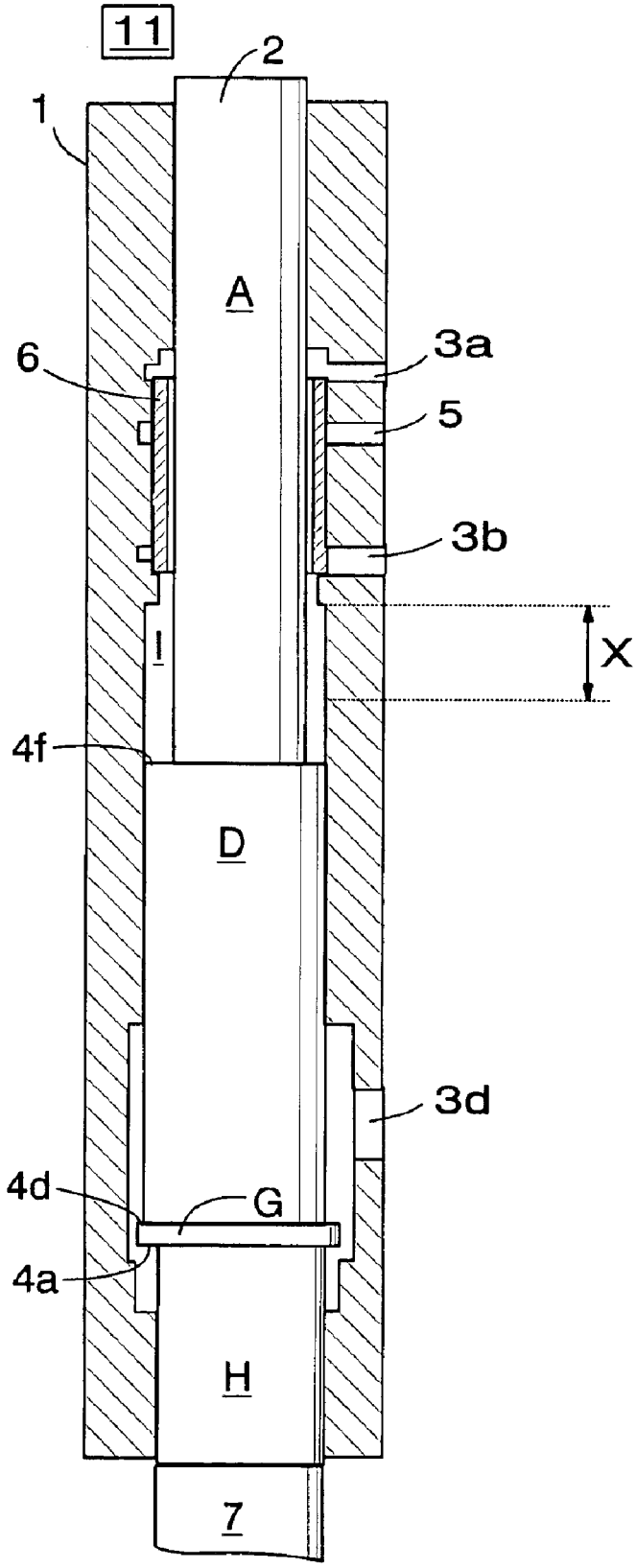
FIG. 3*a* is a schematic, sectional side view of an impact device of the invention.
Figure 3B:
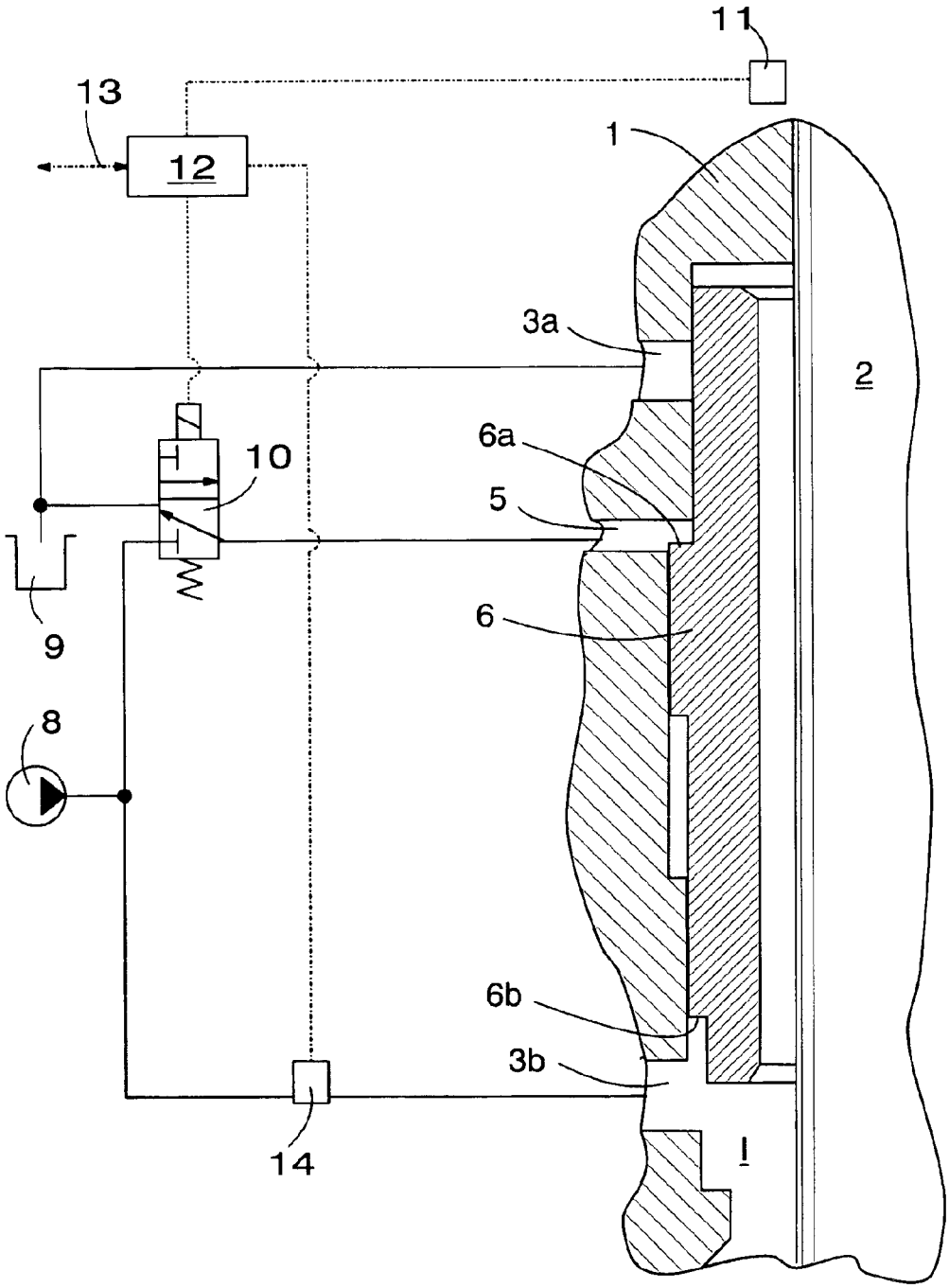
FIG. 3*b* shows a detail of the impact device of FIG. 3*a;*

FIGS. 3*a* and 3*b* show an impact device which differs from the one in FIGS. 1 to 2*b* in that the control pressure of the control slide 6 is not guided from the working pressure duct 3*d* under the control of the percussion piston, but control pressure is guided to the first shoulder 6*a* of the control slide from the pump 8 by means of an electrically operated valve 10. FIG. 3*b* shows the control slide in the impact position, which allows the pressure medium to act on the working pressure space I through the first working pressure duct 3*b*. In the impact position the electrically driven control valve 10 is in its upper position, opening the control duct 5 to the tank 9. Since the first shoulder 6*a* of the control slide is in that situation substantially pressure-free, the pressure acting in the first working pressure duct 3*b* keeps the control slide 6 in the upper position. When the control valve 10 is moved to its lower position, pressure medium from the pump 8 flows to the first shoulder 6*a* and pushes the control slide to its lower position. The control slide 6 thus closes the first working pressure duct 3*b* and opens the first discharge duct 3*a*, thereby enabling the percussion piston 2 to perform its return motion.

The advantage of the solution shown in FIGS. 3*a* and 3*b*, compared to the solution of FIG. 1, is that the frame 1 does not need to be provided with a control pressure duct connected to the front portion of the percussion piston. Another aspect further simplifying the structure is that the second discharge duct 3*c* can be disposed of, because when the control slide is changed from impact position to return position, the pressure acting on the first shoulder 6*a* of the control slide is let into the tank 9 via the electrically driven valve 10. In addition, portion D of the percussion piston may be provided with a constant diameter all the way to portion G. The construction of the invention allows flow leakages to be avoided, i.e. the flow of the pressure medium through gaps between the percussion piston and the frame into the discharge duct can be reduced. The invention reduces the consumption of pressure fluid in the impact device and increases efficiency. A simulation was carried out which showed that applying the solution of FIGS. 3*a* and 3*b*, instead of the solution of FIGS. 1 to 2*b*, increased the volumetric efficiency of the impact device by as much as 20%.

In the impact device of the invention, changes in the travel direction of the percussion piston are controlled by means of the electrically driven control valve 10. To control the electrically driven control valve, the impact device comprises one or more measuring sensors 11 used for determining the position of the percussion piston 2 during the operating cycle. The sensor 11 may be a piezoelectric sensor or an inductive sensor, for example, which identifies the movement of the percussion piston shoulders in relation to the sensor. The sensor is most preferably installed in a pressure-free space. Further, the position of the percussion piston can be accurately measured by means of a laser beam, for example. The measurement data received from the sensor 11 is supplied to the control unit 12 of the impact device, and on the basis of the measurement data and the control parameters stored in advance therein, the control unit generates an electric control signal for controlling the electrically driven control valve 10. The control unit may be for example a programmable logic, computer or some other suitable device capable of computing the speed and position of the percussion piston on the basis of the measurement data, and, further, of taking into account the control parameters for timing the moment when the control slide position is to be changed from impact position to return position, or vice versa. When computing the timing, the control unit also takes into account any delays of the electrically driven control valve. In connection with the manufacture, the control unit may be provided with desired control parameters, or the control unit may use a wired or wireless data transmission connection 13 to communicate with an external system that can be used for changing the control parameters when necessary.

For example, for advancing the change of the travel direction of the percussion piston from the return direction to the impact direction, the percussion piston performs a shorter percussion movement. This allows the impact frequency to be increased, when desired, irrespective of the impact pressure. On the other hand, if the change of the travel direction of the percussion piston from the return direction to the impact direction is to be delayed, the percussion piston performs a longer percussion movement at every stroke. A longer percussion movement allows the percussion piston to achieve a higher maximum velocity, i.e. the impact velocity can be adjusted irrespective of the impact pressure by changing the timing of the operating cycle of the impact device. Reference X in FIG. 3*a* shows the adjustment range the working pressure surface 4*f* achieves, depending on the timing of the reversal of the travel direction of the percussion piston.

FIG. 3*b* further shows a pressure sensor 14 arranged into the working pressure duct 3*b* for measuring impact pressure. The measurement data is transmitted to the control unit 12, which takes the impact pressure into account when determining the timing of the electrically driven control valve 10. This allows the travel of the percussion piston to be adjusted on the basis of the impact pressure in such a manner that the percussion piston can be made to strike at a substantially constant impact rate.

Figure 4:
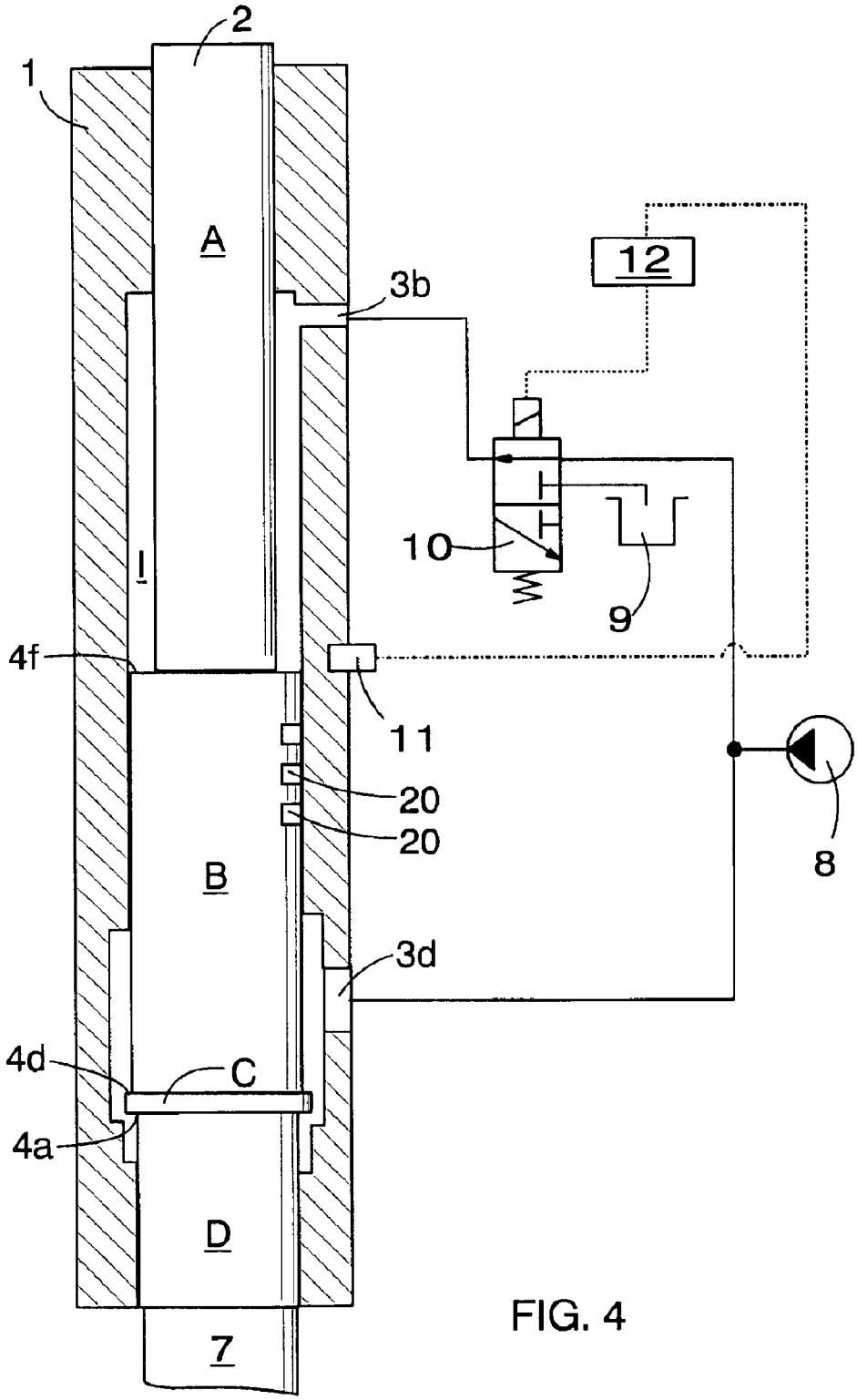
FIG. 4 is a schematic, sectional side view of a second impact device of the invention.

In the impact device shown in FIG. 4 the pressure medium flow acting on the working pressure surface 4*f* of the percussion piston at a particular time is controlled directly by means of the electrically driven control valve 10. This allows the structure of the impact device to be significantly simplified compared to the constructions shown in FIGS. 1 to 3*b*, which facilitates the manufacture of the impact device. In the Figure the control unit 12 has guided the electrically driven control valve 10 to its lower position and opened a connection from the pump 8 to the working pressure duct 3*b* and further to the working surface 4*f* of the percussion piston 2, the percussion piston thus having completed a stroke. The control unit then supplies a control signal to the electrically driven control valve 10, which moves to its upper position. The pressure fluid flow is released from the working pressure space I through the control valve 10 into the tank 9. At the same time, the control valve closes the connection to the pump 8. Since there is substantially no pressure acting on the working pressure space 1, the percussion piston starts its return movement with the pressure medium acting on the working pressure surface 4*a*. The electrically driven control valve used in this solution must be capable of letting a high-volume flow to pass through. Moreover, the pressure loss caused by the control valve should be as small as possible.

The percussion piston 2 of FIG. 4 comprises one or more slots 20 which the sensor 11 detects when the percussion piston passes the sensor. Alternatively, a plural number of sensors may be used to detect a passing percussion piston shoulder.

Figure 5:
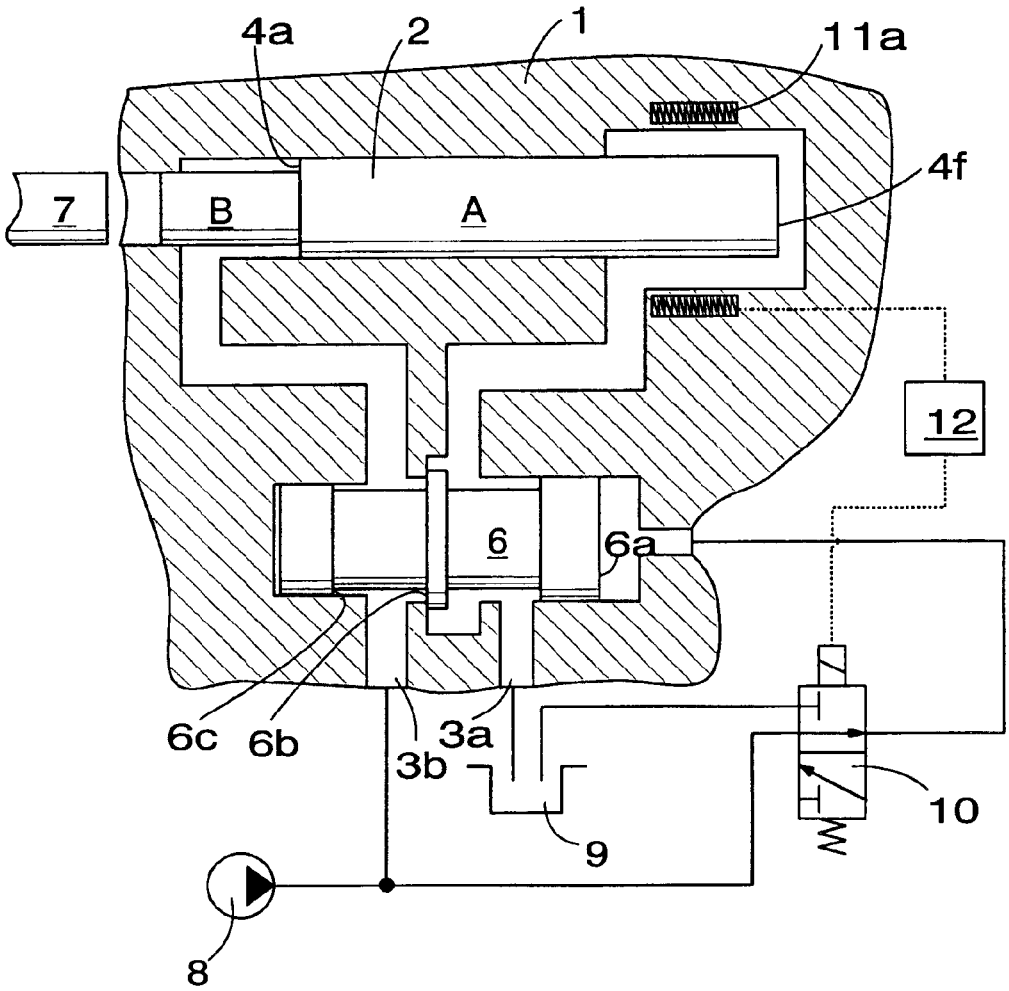
FIG. 5 is a schematic, sectional side view of a third impact device of the invention.

Further, FIG. 5 shows a solution in which a cylindrical control slide 6, i.e. what is known as a control slide valve, is arranged into a separate space formed in the frame 1. The control slide comprises shoulders 6*a*, 6*b* and 6*c*, and by changing the pressure acting on the shoulders, the control slide is reciprocated between its extreme positions to allow the pressure medium flow acting on the working pressure surface 4*f* of the percussion piston to be changed. The travel position of the control slide 6 is adjusted by means of the electrically driven control valve 10. In the situation shown in FIG. 5, the control valve 10 is in its lower position in which it releases the pressure from the pump 8 to the control slide shoulder 6*a* and keeps the control slide 6 in its leftmost extreme position, i.e. in the return position. The working pressure duct 3*b* is in this case connected to the working pressure surface 4*a* of the percussion piston 2 and, correspondingly, the working pressure surface 4*f* to the discharge duct 3*a*, due to which the percussion piston has moved towards its back position. At a moment it has computed, the control unit 12 supplies a control signal to the control valve 10, which changes into the upper position. The control slide shoulder 6*a* is now connected to the tank 9, due to which the pressure of the working pressure duct 3*b* that acts on the control slide shoulder 6*b* moves the control slide to its rightmost extreme position, i.e. to an impact position. This closes the connection from the working pressure surface 4*f* of the percussion piston to the tank, and a pressure medium flow is released from the working pressure duct 3*b* to the working pressure surface 4*f* of the percussion piston, which causes the percussion piston to start an impact movement. In this case the sensor is a coil 11*a* arranged around the percussion piston 2 to indicate changes the movement of the percussion piston causes in the magnetic field.

In the solution of FIG. 5, a sleeve-like control slide can also be applied, provided that the space formed in the frame and the pressure surfaces of the control slide are suitably dimensioned.

The drawings and the related specification are only meant to illustrated the idea of the invention. The details of the invention may vary within the scope of the claims. Therefore, although the electrically driven control valve in its simplest form is any known electrically controlled directional control valve, also other kinds of electrically driven valves can be used. The electrically driven control valve must be fast enough to allow the desired impact frequency to be obtained. Further, although in the examples shown in the Figures the percussion piston is subjected to a continuous hydraulic pressure tending to cause the return movement of the percussion piston, the invention can naturally also be applied to impact devices in which pressure medium flows acting on both the return and impact direction are changed.

What is claimed is:

1. A method for controlling the operating cycle of an impact device, the impact device being designed for breaking rock and comprising a frame, a percussion piston, working pressure surfaces formed on the percussion piston and acting both in the impact direction and in the return direction, working pressure ducts and discharge ducts for guiding pressure medium to act on the working pressure surfaces, and at least one control valve, the method comprising:

varying the pressure medium flows acting on the working pressure surfaces of the percussion piston, by means of the control valves, so as to produce a reciprocating impact and return motion according to the operating cycle of the percussion piston, and for delivering impacts on a tool arranged in the impact direction of the percussion piston, and wherein the method further comprises the steps of measuring the position of the percussion piston by means of at least one sensor during an operating cycle and transmitting the measurement data to a control unit of the impact device;

generating an electric control signal in the control unit, on the basis of the position of the percussion piston and on the control parameters supplied to the control unit for controlling an electrically driven control valve; and guiding the pressure medium, under the control of the electrically driven control valve, to act on the working pressure surfaces of the percussion piston, and away from them for controlling the operating cycle of the impact device.

2. A method according to claim 1, comprising:

guiding the pressure medium to act on the working pressure surfaces of the percussion piston, and away from the surfaces through the electrically driven control valve.

3. A method according to claim 1, comprising:

guiding the pressure medium to act on the working pressure surfaces of the percussion piston, and away from them, by means of a control slide, which is arranged to reciprocate and by guiding the control pressure, by means of the electrically driven control valve to and from the working pressure surfaces of the control slide to move the control slide.

4. A method according to claim 1, comprising:

measuring the pressure acting in the working pressure duct and transmitting the measurement result to the control unit, and by timing the operating cycle of the percussion piston on the basis of the pressure acting in the working pressure duct such that the impact velocity of the percussion piston is substantially constant.

5. An impact device for rock breaking comprising:

a frame, a percussion piston, working pressure surfaces formed on the percussion piston and acting in the impact direction and in the return direction, working pressure ducts and discharge ducts for guiding the pressure medium, at least one control valve for guiding the pressure medium from the working pressure duct to act on the working pressure surfaces of the percussion piston, and away from them into the discharge duct so as to reciprocate the percussion piston in relation to the frame and deliver blows on a tool arranged in the impact direction of the percussion piston, the impact device further comprises:

at least one sensor for determining the position of the percussion piston in relation to the frame;

an electrically driven control valve;

a control unit; and wherein the control unit is arranged to generate a control signal on the basis of measurement data received from the sensor and control parameters supplied to the control unit for controlling the electrically driven control valve;

and the electrically driven control valve is arranged to guide the pressure medium to act on the working pressure surfaces of the percussion piston, and away from them for controlling the operating cycle of the impact device.

6. An impact device according to claim 5, wherein the pressure medium flows, from the working pressure duct to the working pressure surfaces of the percussion piston and away from the surfaces into the discharge duct, are arranged to be guided through the electrically driven control valve.

7. An impact device according to claim 5, wherein the impact device comprises a control slide arranged into a space formed for it;

the control slide comprises working pressure surfaces, whereby it is movable in a reciprocating manner in the space by the impact of a pressure medium;

and, depending on its position, the control slide is arranged to guide pressure medium to act on the working pressure surfaces of the percussion piston, and away from them;

and the electrically driven control valve is arranged to guide the pressure medium to the working pressure surfaces of the control slide for moving the control slide into a desired position.

8. An impact device according to claim 7, wherein the control slide is a sleeve-like piece; and the control slide is arranged around the percussion piston.

9. An impact device according to claim 7, wherein the control slide is a cylindrical piece;

and the frame of the impact device comprises a pressure space separate from the percussion piston space;

and the control slide being movably arranged into the pressure space.

10. An impact device according to claim 7, wherein the impact device comprises a pressure sensor for measuring the working pressure to be supplied to the impact device;

and the control unit is arranged to control the operating cycle of the percussion piston, taking into account the working pressure.

* * * * *